US010030517B2

(12) United States Patent
Corcoran et al.

(10) Patent No.: US 10,030,517 B2
(45) Date of Patent: Jul. 24, 2018

(54) ROTOR DISK BOSS

(71) Applicant: United Technologies Corporation, Hartford, CT (US)

(72) Inventors: Kevin L. Corcoran, Middletown, CT (US); Jody M Grosso, Portland, CT (US); Christopher St. Mary, Hebron, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 496 days.

(21) Appl. No.: 14/600,757

(22) Filed: Jan. 20, 2015

(65) Prior Publication Data

US 2016/0208612 A1 Jul. 21, 2016

(51) Int. Cl.

| | |
|---|---|
| ***F01D 5/02*** | (2006.01) |
| ***F01D 5/12*** | (2006.01) |
| ***F01D 25/00*** | (2006.01) |
| ***F01D 5/06*** | (2006.01) |

(52) U.S. Cl.

CPC ..... *F01D 5/02* (2013.01); *F01D 5/022* (2013.01); *F01D 5/06* (2013.01); *F01D 5/12* (2013.01); *F01D 25/00* (2013.01); *F01D 25/005* (2013.01); *F05D 2220/32* (2013.01); *F05D 2230/30* (2013.01); *F05D 2240/24* (2013.01)

(58) Field of Classification Search

CPC ... F01D 5/02; F01D 5/022; F01D 5/06; F01D 25/00; F01D 25/005; F01D 5/12; F01D 5/08; F01D 5/081; F05D 2240/24; F05D 2220/32; F05D 2230/30

See application file for complete search history.

(56) References Cited

U.S. PATENT DOCUMENTS 4,529,452 A * 7/1985 Walker ..... B21J 1/00 148/527
5,275,534 A * 1/1994 Cameron ..... F01D 11/006 416/220 R
5,688,108 A * 11/1997 Dierksmeier ..... F01D 5/081 415/200
6,857,851 B2 * 2/2005 Avignon ..... F01D 5/082 415/116

(Continued)

FOREIGN PATENT DOCUMENTS

EP 0541250 5/1993
EP 0541250 A1 * 5/1993 ..... F01D 11/006

(Continued)

OTHER PUBLICATIONS

Extended European Search Report dated May 27, 2016 in European Application No. 16152010.1.

*Primary Examiner* — Eldon Brockman
(74) *Attorney, Agent, or Firm* — Snell & Wilmer L.L.P.

(57) ABSTRACT

The present disclosure provides devices and methods related to rotor disk bosses. For example, a rotor disk assembly comprises a first rotor disk, wherein the first rotor disk comprises a web, disposed between a rim and a bore. The rotor disk assembly further comprises a second rotor disk operatively coupled to the first rotor disk, an inter-disk device disposed on the second rotor disk and extending axially toward the first rotor disk, and a boss disposed on the first rotor disk, wherein the boss protrudes axially from the web toward the inter-disk device.

12 Claims, 5 Drawing Sheets

(56) References Cited

U.S. PATENT DOCUMENTS

| | | | | |
|---|---|---|---|---|
| 7,552,590 | B2 * | 6/2009 | Drevs | F01D 5/08 415/115 |
| 8,465,252 | B2 * | 6/2013 | Bintz | F01D 5/087 415/115 |
| 9,091,173 | B2 * | 7/2015 | Mosley | F01D 5/082 |
| 2010/0124495 | A1 * | 5/2010 | Bifulco | F01D 5/066 415/216.1 |
| 2010/0266387 | A1 * | 10/2010 | Bintz | F01D 5/087 415/115 |
| 2013/0323010 | A1 * | 12/2013 | Mosley | F01D 25/12 415/1 |

FOREIGN PATENT DOCUMENTS

| | | |
|---|---|---|
| EP | 2123860 | 11/2009 |
| EP | 2186997 | 5/2010 |

* cited by examiner

ROTOR DISK BOSS

FIELD OF THE DISCLOSURE

The present disclosure relates to rotor disks, and more particularly, to rotor disk bosses.

BACKGROUND OF THE DISCLOSURE

Gas turbine engines typically include a compressor section, a combustor section, and a turbine section, disposed about an axial centerline and arranged in flow series with an upstream inlet at the combustor section and a downstream exhaust at the turbine section. The compressor section typically includes stacked rotors across and between which air flows as it is compressed.

Compressor sections may also include various inter-disk devices or features attached interstitially between stacked rotor disks. Inter-disk devices or features may become detached from a rotor disk during operation of the engine. Such detachment may impede the proper functioning of the gas turbine engine, may cause damage to an adjacent rotor disk, and may decrease the cycle life of rotor disks.

SUMMARY OF THE DISCLOSURE

The present disclosure provides devices related to rotor disk bosses. A rotor disk assembly comprises a first rotor disk, wherein the first rotor disk comprises a web, disposed between a rim and a bore. The rotor disk assembly further comprises a second rotor disk operatively coupled to the first rotor disk, an inter-disk device disposed on the second rotor disk and extending axially toward the first rotor disk, and a boss disposed on the first rotor disk, wherein the boss protrudes axially from the web toward the inter-disk device.

A rotor disk assembly comprises a first rotor disk operatively coupled to a second rotor disk, and a bore cavity defined by, and disposed between, the first rotor disk and the second rotor disk. The second rotor disk comprises a spacer arm disposed in the bore cavity and extending axially toward the first rotor disk. The first rotor disk comprises a boss disposed in the bore cavity and protruding axially from the first rotor disk toward the second rotor disk, whereby the boss forms a buffer between the spacer arm and the first rotor disk.

In various embodiments, the present disclosure provides methods for designing a rotor disk boss. Such methods may be used to determine a probable point of contact on a rotor disk in response to an inter-disk device failure, and to redesign a rotor disk to include a rotor disk boss.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

Figure 1:
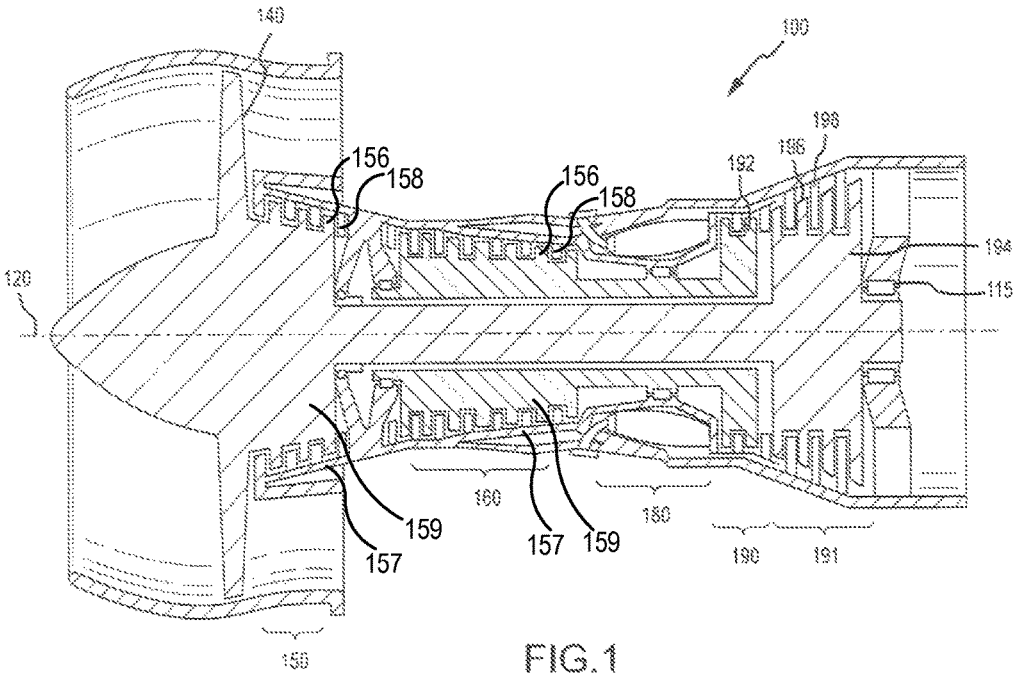
FIG. 1 illustrates a schematic cross-section view of a gas turbine engine in accordance with various embodiments.

Referring to FIG. 1, a gas turbine engine 100 (such as a turbofan gas turbine engine) is illustrated according to various embodiments. Gas turbine engine 100 is disposed about an axial centerline axis, which is the axis of rotation 120. Gas turbine engine 100 comprises a fan 140, compressor sections 150 and 160, a combustion section 180, and turbine sections 190, 191. The fan 140 drives air into compressor sections 150, 160, which further drive air along a core flow path for compression and communication into the combustion section 180. Air compressed in the compressor sections 150, 160 is mixed with fuel and burned in combustion section 180 and expanded across the turbine sections 190, 191. The turbine sections 190, 191 include high pressure rotors 192 and low pressure rotors 194, which rotate in response to the expansion. The turbine sections 190, 191 comprise alternating rows of rotary airfoils or blades 196 and static airfoils or vanes 198. Cooling air is supplied to the turbine sections 190, 191 from the compressor sections 150, 160. A plurality of bearings 115 supports spools in the gas turbine engine 100.

The forward-aft positions of gas turbine engine 100 lie along axis of rotation 120. For example, fan 140 is forward of turbine section 190 and turbine section 190 is aft of fan 140. During operation of gas turbine engine 100, air flows from forward to aft, from fan 140 to turbine section 190. As air flows from fan 140 to the more aft components of gas turbine engine 100, the axis of rotation 120 defines the direction of the air stream flow.

The compressor sections 150, 160 comprise a rotor disk assembly 159 and a stator assembly 157, operatively coupled to one another to create alternating rows of rotary airfoils or blades 156 and static airfoils or vanes 158. The rotor disk assembly 159 comprises a series of stacked rotor disks operatively coupled to one another and oriented about an axis of rotation 120. FIG. 1 provides a general understanding of the sections in a gas turbine engine, and is not intended to limit the disclosure.

A rotor disk comprises a web disposed between a rim and a bore. The rotor disk is oriented about an axis of rotation, and the bore is disposed radially inward of the web and the rim. Because rotor disks operate at high rotational speeds and high temperatures, the web is thinner than both the rim and the bore, and connects the rim and the bore with a smooth and continuous curved surface. The rotor disk is coupled to a plurality of blades. Each blade is disposed on the rim of the rotor disk and extends radially outward therefrom.

Various inter-disk devices are attached to a rotor disk and suspended or hung in a bore cavity defined by and disposed between stacked rotor disks. For example, a plurality of air transport tubes is attached to the aft side of a forward rotor disk such that it is suspended in the bore cavity defined by the forward rotor disk and an aft rotor disk. During operation, an inter-disk device may become detached from the forward rotor disk and contact the aft rotor disk. Such contact may result in contact damage, galling, gouging, and the like, thereby decreasing the cycle life of the rotor disk.

Figure 2A:
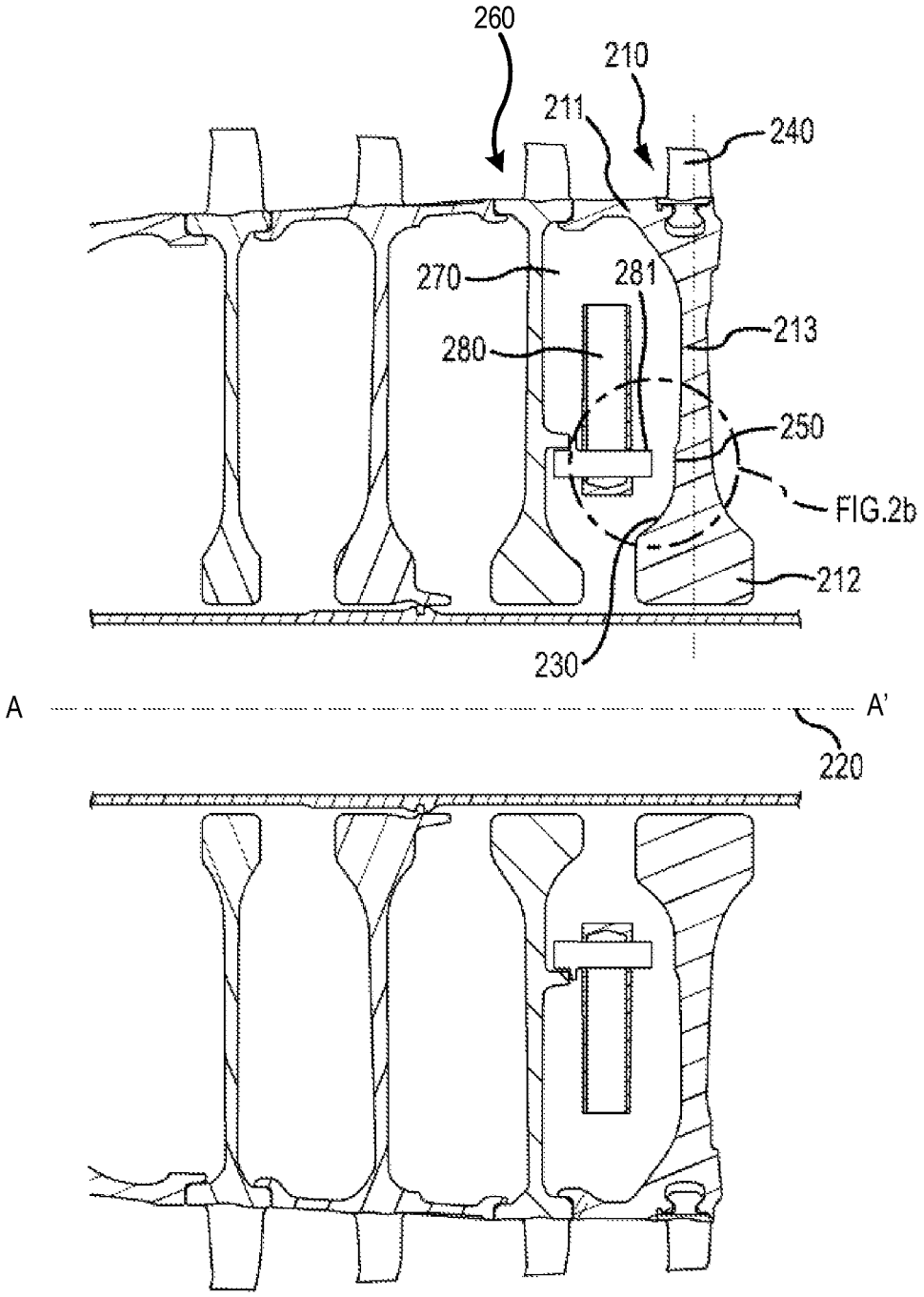
FIG. 2*a* illustrates a cross section view of a compressor rotor disk assembly in cross section in accordance with various embodiments.
Figure 2B:
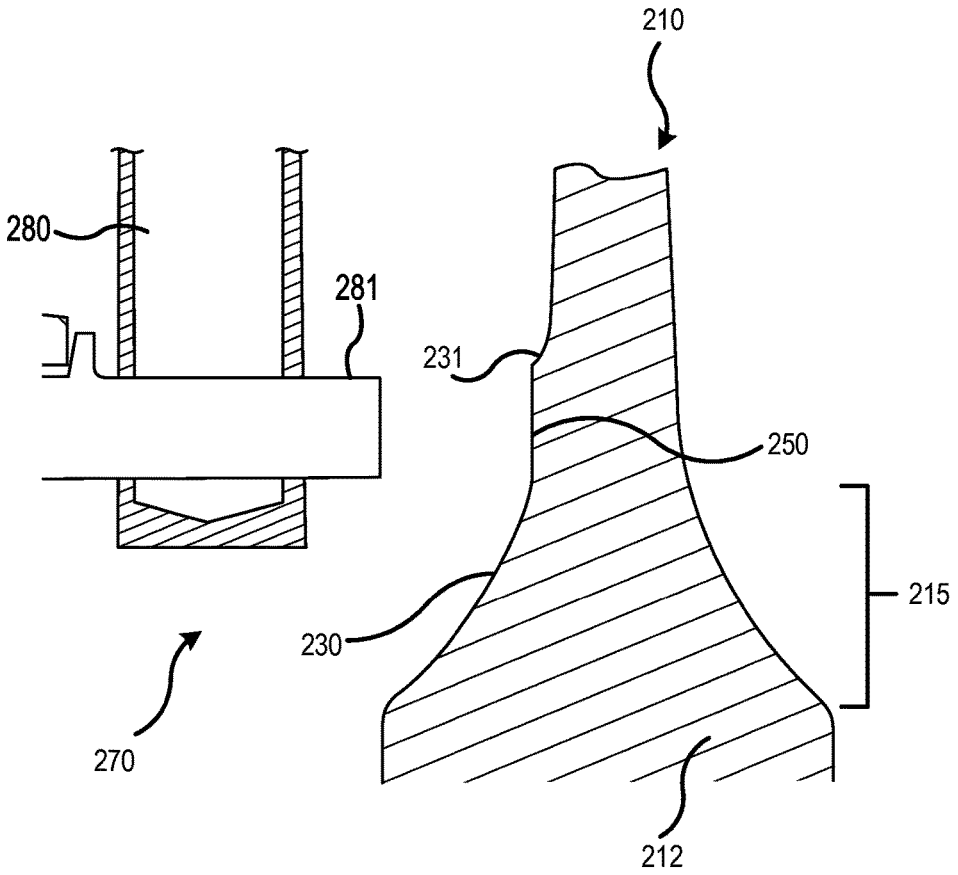
FIG. 2*b* illustrates an enlarged view of a portion of FIG. 2*a;*

With reference to FIGS. 2*a* and 2*b*, a first rotor disk 210 and a second rotor disk 260 are stacked and oriented about an axis of rotation 220, marked A-A', with A being located forward of A' and A' being located aft of A. Stated differently, the first rotor disk 210 is disposed aft of the second rotor disk 260. The first rotor disk 210 comprises a web 213 disposed between a rim 211 and a bore 212. The web 213, rim 211, and bore 212 are integral portions of the first rotor disk 210, which is in a unitary state. The bore 212 is disposed radially inward of the rim 211 and the web 213. The bore 212 abuts the web 213 at the radially inwardmost portion of the web 213, which is referred to herein as the web foot 215. The bore 212 is axially thicker than the web 213 so that the web foot 215 forms a filleted transition region, with opposing axial faces of the web foot 215 comprising arcuate filleted surfaces. The first rotor disk 210 is coupled to a plurality of blades 240. Each blade is disposed on the rim 211 of the first rotor disk 210.

The first rotor disk 210 further comprises a boss 250 that engages an axially extending spacer arm 281 (discussed below) secured to the second rotor disk 260. The boss 250 is disposed between the rim 211 and the bore 212 on a forward surface of the first rotor disk 210. The boss 250 is axially closer to the spacer arm 281 than the rest of the web 213 is to the spacer arm 281. The boss 250 extends toward the spacer arm 281 in a forward axial direction from the forward surface of the first rotor disk 210. In various embodiments, the boss 250 can be generally planar and/or pitched relative to the web 213. In further embodiments, the boss 250 can comprise at least one arcuate surface.

As illustrated in FIG. 2*b*, the boss 250 can be disposed radially outward of, and immediately adjacent to, the web foot 215 in various embodiments. A radial outer edge of the boss 250 can transition to the web 213 via a first arcuate filleted edge 231. Stated differently, the boss 250 can be disposed between the web and a first arcuate filleted surface, wherein the first arcuate filleted surface is the forward surface of the filleted transition region. The boss 250 can protrude axially from the web 213 at the radial outer edge of the boss 250, and can connect to the web foot 215 at a radial inner edge of the boss 250 with a smooth and continuous surface.

In further embodiments, the boss 250 can be disposed on the web 213 not immediately adjacent to the web foot 215. The boss 250 can protrude axially from the web 213 at the radial outer edge of the boss 250 and can connect to the web at the radial outer edge via a first arcuate filleted edge. The boss 250 can protrude axially from the web 213 at the radial inner edge of the boss 250 and can connect to the web at the radial inner edge via a second arcuate filleted edge.

The radial-direction span of the boss 250 can be limited to the area in which the spacer arm 281 can contact the web 213. Various portions of the first rotor disk 210, including without limitation, the web 213 and the web foot 215, can be sensitive to contact by the spacer arm 281. Contact between the first rotor disk 210 and the spacer arm 281 can decrease the cycle life of the first rotor disk 210. The boss 250 serves as a buffer between the spacer arm 281 the web 213, and/or between the spacer arm 281 and the web foot 215. The boss 250 can increase the thickness of a portion of the rotor disk 210. The boss 250 decreases the linear distance between the spacer arm 281 and the boss 250.

Figure 3:
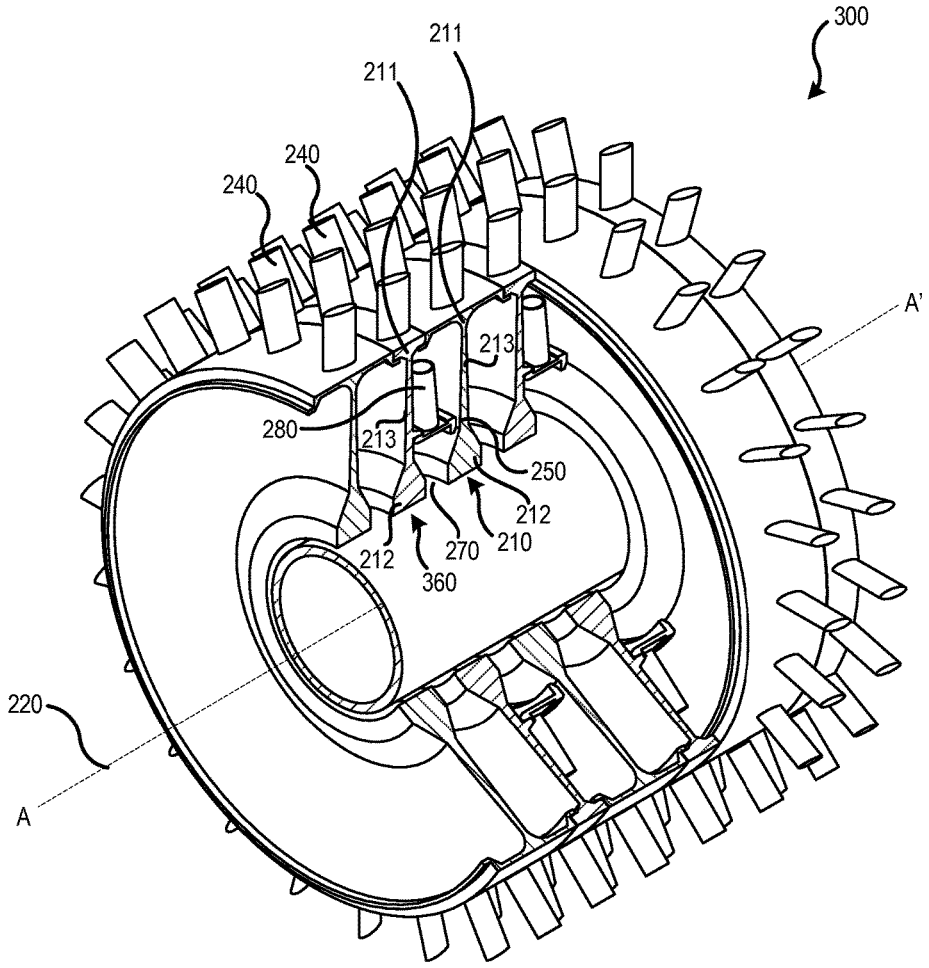
FIG. 3 illustrates a schematic cross-section view of a compressor rotor disk assembly.

With reference to FIG. 3, a rotor disk assembly 300 comprises a first rotor disk 210 operatively coupled to a second rotor disk 360, each of the first rotor disk 210 and the second rotor disk 360 further comprising a web 213 disposed between a rim 211 and a bore 212. Rotor disk assembly 300 further comprises a bore cavity 270 defined by, and disposed between, the first rotor disk 210 and the second rotor disk 360, at least one inter-disk device 280 disposed at least partially in the bore cavity 270, a boss 250 disposed in the bore cavity 270 and on the first rotor disk 210, and a plurality of blades 240 coupled to the rim 211 of the first rotor disk 210 and the second rotor disk 360. The rotor disk assembly 300 is oriented about an axis of rotation 220, marked A-A', with A being located forward of A' and A' being located aft of A.

The inter-disk device 280 can comprise a plurality of air transport tubes coupled to a rotor disk by a hoop. The air transport tubes can be disposed in the bore cavity 270 such that air flowing radially inward from the blades will be smoothly directed toward the bores. The inter-disk device 280 can comprise any device disposed at least partially between rotor disks of a rotor disk assembly, and/or any means of directing air toward the bore including, without limitation, paddles or vanes.

The inter-disk device 280 can be coupled to the second rotor disk 360 such that it is disposed in the bore cavity 270. A spacer arm 281 of an inter-disk device 280—that is, the portion of the inter-disk device 280 extending farthest in an aft direction into the bore cavity 270—is disposed adjacent to, and forward of, the boss 250. The boss 250 is disposed adjacent to, and aft of, the spacer arm 281. As already described and with reference to FIGS. 2*a* and 2*b*, the boss 250 can be disposed on the rotor disk 210 between the web 213 and the web foot 215. The boss 250 can increase the thickness of a portion of the first rotor disk 210. The boss 250 is configured to decrease the linear distance between the spacer arm 281 and the rotor disk 210.

Methods of designing a rotor disk are provided. Inter-disk devices or features may become detached from a rotor disk during operation of the engine. Detachment of an inter-disk device and/or spacer arm from a rotor disk constitutes a failure. Upon detachment, an inter-disk device will contact a rotor disk aft of the inter-disk device at a point of contact. The point of contact is the portion of the web contacted by the spacer arm in the event of an inter-disk device failure. The point of contact may be determined experimentally, experientially, predictively, or by any other appropriate means.

Prior to detachment, a point of contact is calculated. With reference to FIGS. 2*a* and 2*b*, point of contact may occur at the web foot 215 and/or the web 213. A cycle life of the rotor disk in the event of an inter-disk device failure is determined. The cycle life may be determined through lifing analysis, review of part history, material review of the rotor disk, computer modeling, or any other suitable method. In response to an inadequate cycle life, the rotor disk may be redesigned to include a rotor disk boss.

Figure 4:
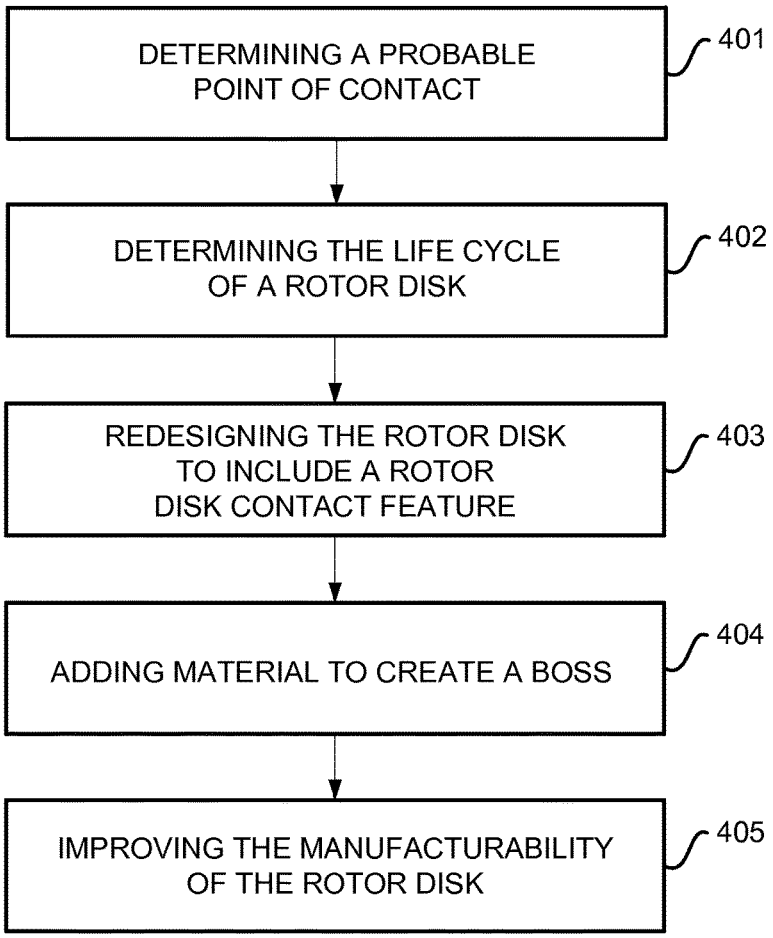
FIG. 4 illustrates a method of designing a rotor disk and boss.

With reference to FIG. 4, a method comprises determining a point of contact on a rotor disk in response to an inter-disk device failure (Step 401), determining a cycle life of the rotor disk in response to an inter-disk device failure (Step 402), and redesigning the rotor disk to include a boss (Step 403).

The redesigning step further comprises adding material at the point of contact to create a boss (Step 404). The adding step causes the boss to protrude from the surface of the rotor disk in an axial direction. The adding step moves the point of contact in an axial direction. In various embodiments, a method of designing a rotor disk further comprises improving the manufacturability of the rotor disk (Step 405). The improving step comprises at least one of creating a filleted transition between the boss and an adjacent web, bore or rim, decreasing the size of the boss, or decreasing the weight of the rotor disk.

No element, component, or method step in the present disclosure is intended to be dedicated to the public regardless of whether the element, component, or method step is explicitly recited in the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rotor disk assembly, comprising:

a first rotor disk, wherein the first rotor disk comprises a web, disposed between a rim and a bore, wherein the bore abuts the web at a web foot that is a radially inwardmost portion of the web;

a second rotor disk, operatively coupled to the first rotor disk;

an inter-disk device, disposed on the second rotor disk and extending axially toward the first rotor disk, wherein the inter-disk device comprises a spacer arm, wherein the spacer arm is a portion of the inter-disk device extending farthest axially from the second rotor disk; and a boss, disposed on the first rotor disk, wherein the boss protrudes axially from the web toward the spacer arm of the inter-disk device, wherein a distance is defined between the spacer arm and the boss and wherein a radial-direction span of the boss is radially aligned with the spacer arm, wherein the boss is disposed radially outward of, and immediately adjacent to, the web foot, wherein the boss comprises a planar surface extending radially, wherein the web foot extends axially outward and away, relative to a radius of the first rotor disk, from a radial inner edge of the planar surface.

2. The rotor disk assembly of claim 1, wherein the boss extends 360 degrees around an axis of rotation on the first rotor disk and is disposed at a uniform distance radially outward from the bore.

3. The rotor disk assembly of claim 2, wherein the boss is disposed on the web.

4. The rotor disk assembly of claim 2, wherein the boss increases the thickness of a portion of the first rotor disk.

5. The rotor disk assembly of claim 2, wherein the boss is in a unitary state with the first rotor disk.

6. The rotor disk assembly of claim 5, wherein the boss comprises a nickel-chromium alloy.

7. A gas turbine engine comprising the rotor disk of claim 1.

8. A rotor disk assembly, comprising:

a first rotor disk, wherein the first rotor disk comprises a web, disposed between a rim and a bore, wherein the bore abuts the web at a web foot that is a radially inwardmost portion of the web;

a second rotor disk, operatively coupled to the first rotor disk;

a bore cavity defined by, and disposed between, the first rotor disk and the second rotor disk;

an inter-disk device, disposed at least partially in the bore cavity, wherein the inter-disk device is disposed on, and operatively coupled to, the second rotor disk and comprises a spacer arm, wherein the spacer arm is a portion of the inter-disk device extending farthest axially from the second rotor disk into the bore cavity;

a boss, disposed in the bore cavity and on the first rotor disk, wherein the boss protrudes axially from the web toward the spacer arm of the inter-disk device, wherein a distance is defined between the spacer arm and the boss and wherein a radial-direction span of the boss is radially aligned with the spacer arm, wherein the boss is disposed radially outward of, and immediately adjacent to, the web foot, wherein the boss comprises a planar surface extending radially, wherein the web foot extends axially outward and away, relative to a radius of the first rotor disk, from a radial inner edge of the planar surface, wherein the boss is axially closer to the spacer arm than the rest of the web is to the spacer arm; and a plurality of blades operatively coupled to the first rotor disk and the second rotor disk.

9. The rotor disk assembly of claim 8, wherein the inter-disk device comprises a plurality of air transport tubes.

10. The rotor disk assembly of claim 9, wherein the air transport tubes direct flowing air radially inward toward the bore.

11. The rotor disk assembly of claim 8, wherein the boss comprises a nickel-chromium alloy.

12. A gas turbine engine comprising the rotor disk assembly of claim 8.

* * * * *